US005848598A

United States Patent [19]

Walz et al.

[11] Patent Number: 5,848,598

[45] Date of Patent: Dec. 15, 1998

[54] HAIR TREATMENT DISPENSING CONTAINER

[76] Inventors: David K. Walz, 5279 Greencastle Way, Stone Mountain, Ga. 30087; Frank Van Haltern, Jr., 1670 Montcliff Ct., Decatur, Ga. 30033

[21] Appl. No.: 102,193

[22] Filed: Jun. 22, 1998

[51] Int. Cl.[6] ..... A45D 24/22

[52] U.S. Cl. ..... 132/112; 132/116; 132/212; 401/190; 222/192

[58] Field of Search ..... 132/112, 212, 132/148, 116, 113, 114, 320; 401/137, 281, 284, 190, 183, 273; 222/192, 402.1, 402.3, 402.13; 119/603, 604, 611

[56] References Cited

U.S. PATENT DOCUMENTS

| | | | |
|---|---|---|---|
| 3,368,569 | 2/1968 | Lawrence | 132/116 |
| 4,209,027 | 6/1980 | Morganroth | 132/212 |
| 4,354,512 | 10/1982 | Roppatte, Jr. | 132/212 |
| 4,783,186 | 11/1988 | Manning et al. | 401/190 |
| 5,000,199 | 3/1991 | Kuranski et al. | 132/112 |
| 5,035,251 | 7/1991 | Hollenberg et al. | 132/112 |
| 5,361,941 | 11/1994 | Parekh et al. | 222/95 |
| 5,555,899 | 9/1996 | Foreman | 132/112 |
| 5,755,241 | 5/1998 | Cheung | 132/112 |
| 5,772,077 | 6/1998 | Tafur | 132/112 |

*Primary Examiner*—Cary E. O'Connor
*Assistant Examiner*—Pedro Philogene
*Attorney, Agent, or Firm*—Rodgers & Rodgers

[57] ABSTRACT

A hair treatment dispensing container including hair straightening chemical under pressure and dispensable through an applicator arm directly to human hair and a hair separation extension rotatably mounted on the applicator arm.

6 Claims, 7 Drawing Sheets

HAIR TREATMENT DISPENSING CONTAINER

BACKGROUND OF THE INVENTION

This invention relates to containers for use in storing and dispensing hair treatment products and more specifically lye and nonlye-based hair straighteners and relaxers. Traditionally hair straighteners have been applied by hair care professionals to a customer's hair by means of manually dipping a comb, spatula, or gloved finger into an open jar of viscous hair straightening chemical and then applying the chemical to the customer's hair. A less effective means of applying straightener has been to utilize a squeeze bottle or tube to apply the chemical to the customer's hair. These methods require excessive hand manipulation and result in an uneven application of the chemical.

In order for human hair to be effectively straightened, straightening chemical is applied evenly to successive hair sections and remains in contact with the hair for a precise length of time. If the chemical is left on the hair for a period of time less than required, the hair is not properly straightened and, if left in contact with the hair for an excessive period of time, the customer's scalp can be burned. The length of time the chemical is in actual contact with the hair and scalp is critical.

SUMMARY OF THE INVENTION

A hair treatment dispensing container comprising a cylindrical body element having a top and bottom, a flexible bag contained therein under pressure for dispensing hair straightening chemicals from the bag through an applicator arm secured to the top of the body element by means of an attachment cap.

DESCRIPTION OF THE PREFERRED EMBODIMENT

Figure 1:
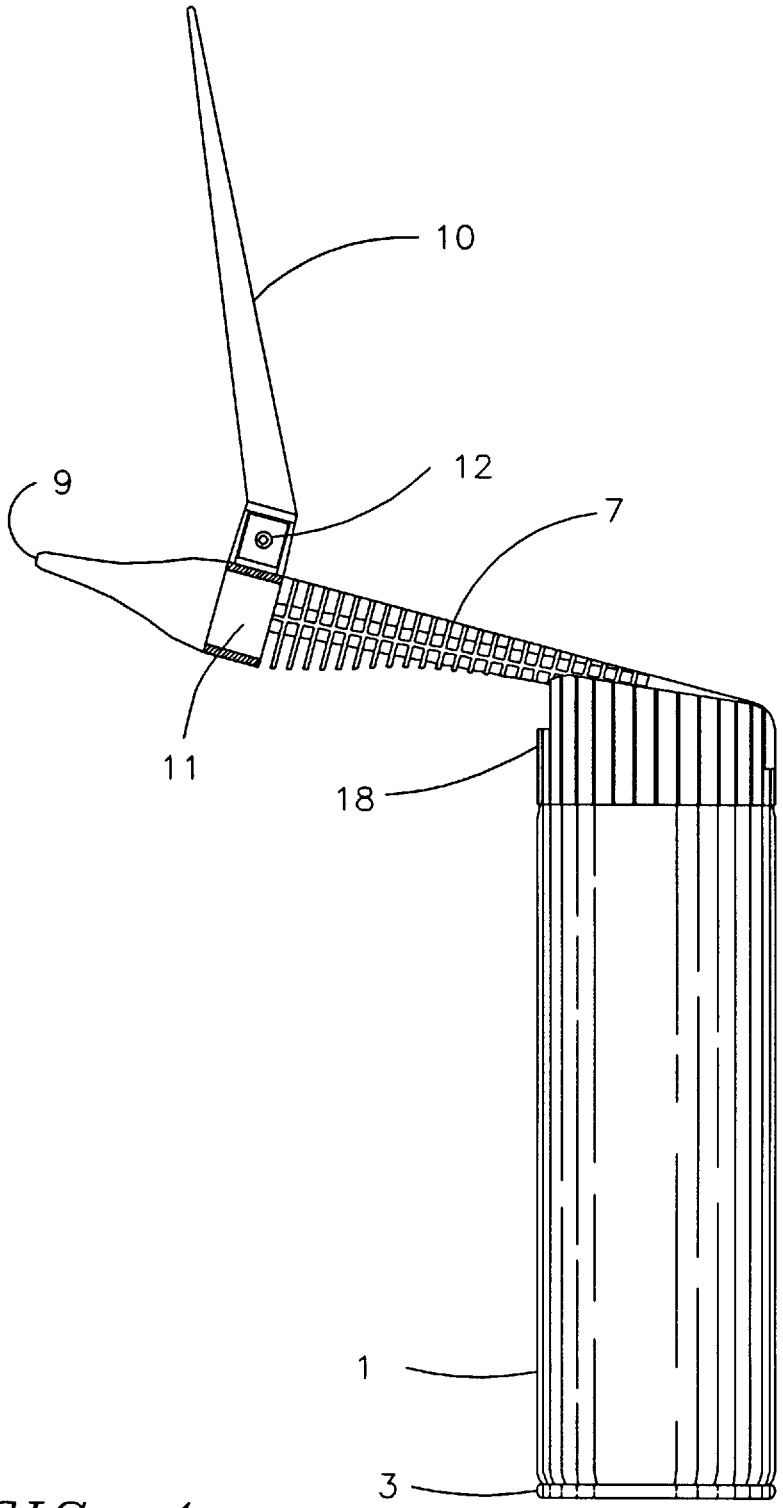
FIG. 1 is an elevational view of one form of the hair treatment dispensing container according to this invention.

In the drawings, the numeral 1 designates the cylindrical body element of the hair treatment dispensing container. Container top 2 is secured in an airtight fashion to the upper edge of body element 1 and, in like manner, container bottom 3 is secured in an airtight fashion to the lower edge of body element 1.

Flexible bag 4 is disposed internally of body element 1 for the purpose of storing highly viscose hair treatment products such as lye-based hair straightening and relaxing chemicals and other similar materials. Valve 5 is disposed within container top 2 and is operably interconnected with flexible bag 4 in a conventional manner. Also, plug 6 is provided in connection with container bottom 3 to seal the container after pressurized fluid is introduced therein through an opening in container bottom 3, as is well known.

For the purpose of dispensing hair treatment product to a customer's hair, elongated applicator arm 7 is provided and is secured by means of attachment cap 18 to container top 2 and is operably interconnected to valve 5. More specifically, channel 8 is disposed within applicator arm 7 and, at the proximal end thereof, communicates directly with valve 5 and, at the distal end thereof, includes slotted opening 9 through which hair treatment product is dispensed. Applicator arm 7 and attachment cap 18 are conventionally disengageable with respect to container top 2 in order to facilitate shipping.

According to one aspect of this invention, hair separation extension 10 is provided and is rotatably mounted on applicator arm 7 by means of band 11. Band 11 can be integrally joined to applicator arm 7 if rotation is not desired. Hair separation extension 10 is attached to band 11 by means of conventional fastener 12.

In operation, applicator arm 7 is manually pressed downwardly in the vicinity of attachment cap 18 thereby opening valve 5 which allows pressurized hair treatment chemical contained in flexible bag 4 to be dispensed through channel 8 and outwardly through opening 9. Of course, the amount of chemical dispensed is determined by varying the downward pressure on applicator arm 7.

In order to complete the process, hair separation extension 10 is utilized to separate successive sections of hair in order to effectively expose new hair growth near the scalp for application of the straightening and relaxing chemical. In order to position extension 10 in accordance with the particular needs of the hair care professional, extension 10 is rotatable 360 degrees around applicator arm 7 by means of band 11 and then held in any desired position by tightening fastener 12 and thereby increasing rotary friction.

Figure 2:
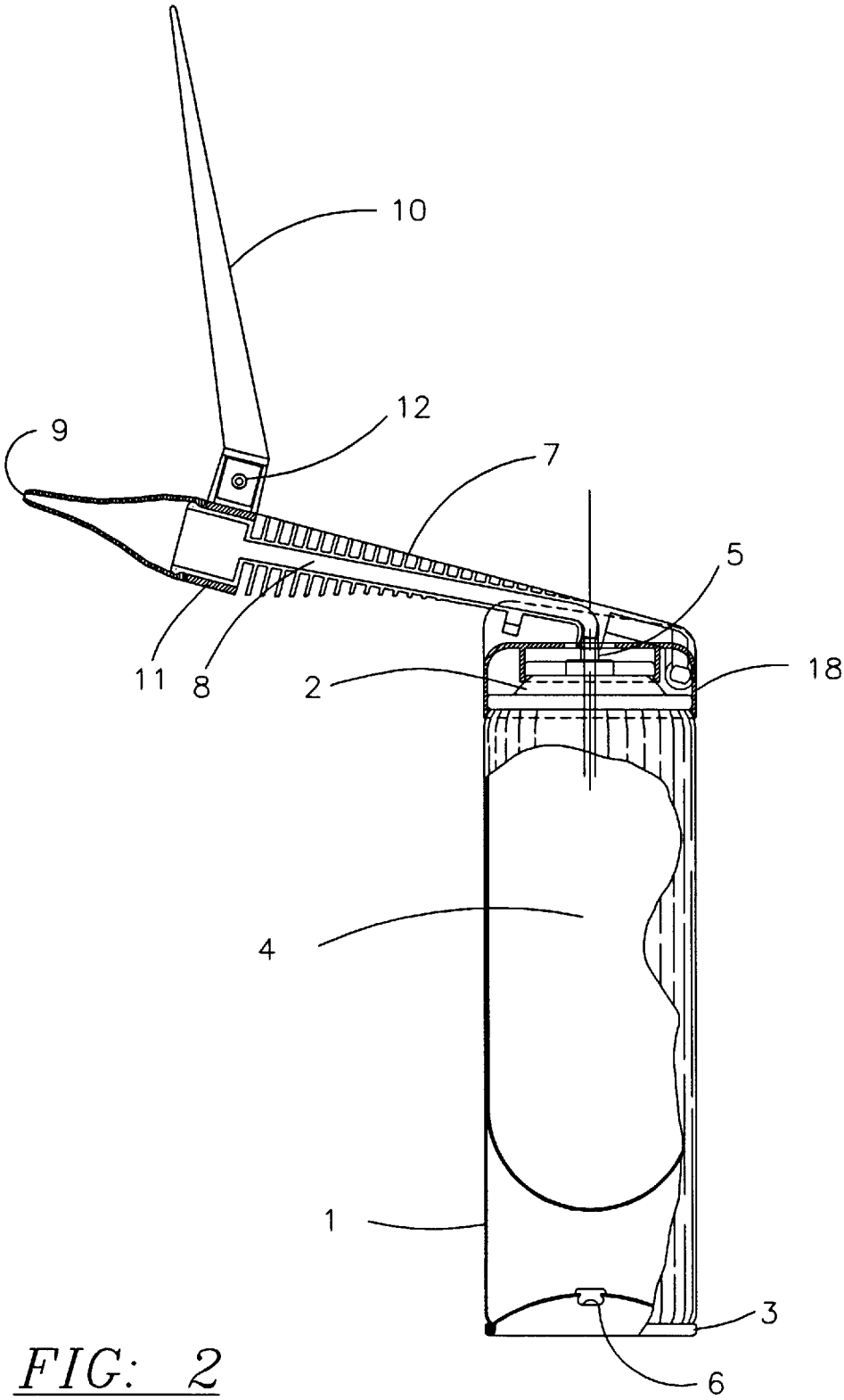
FIG. 2 is a cross-sectional view of the container as shown in FIG. 1.
Figure 3:
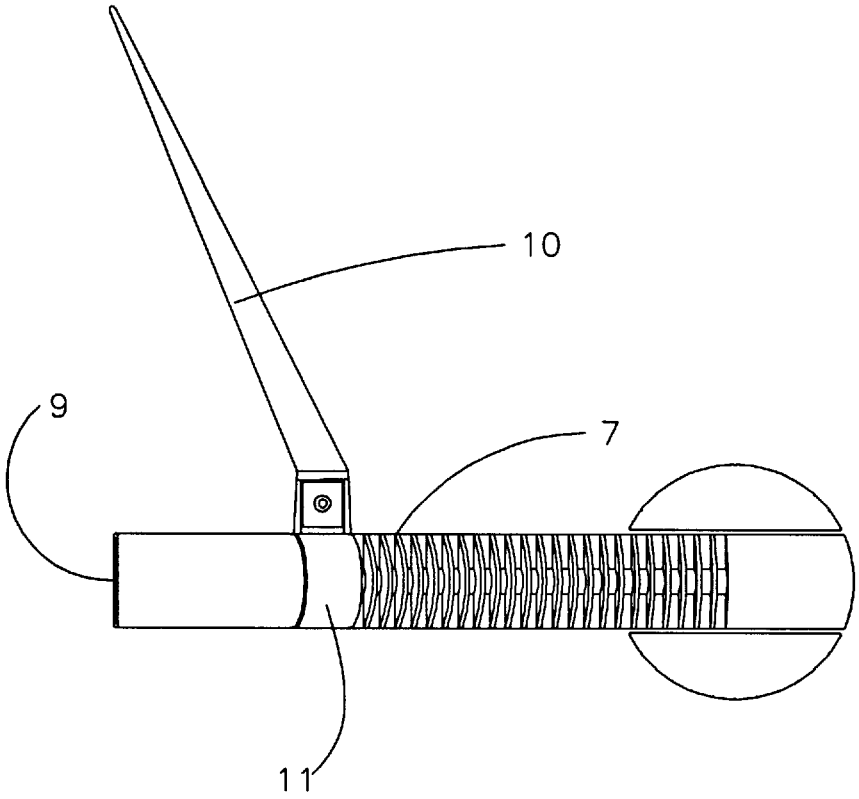
FIG. 3 is a top plan view of the container.
Figure 4:
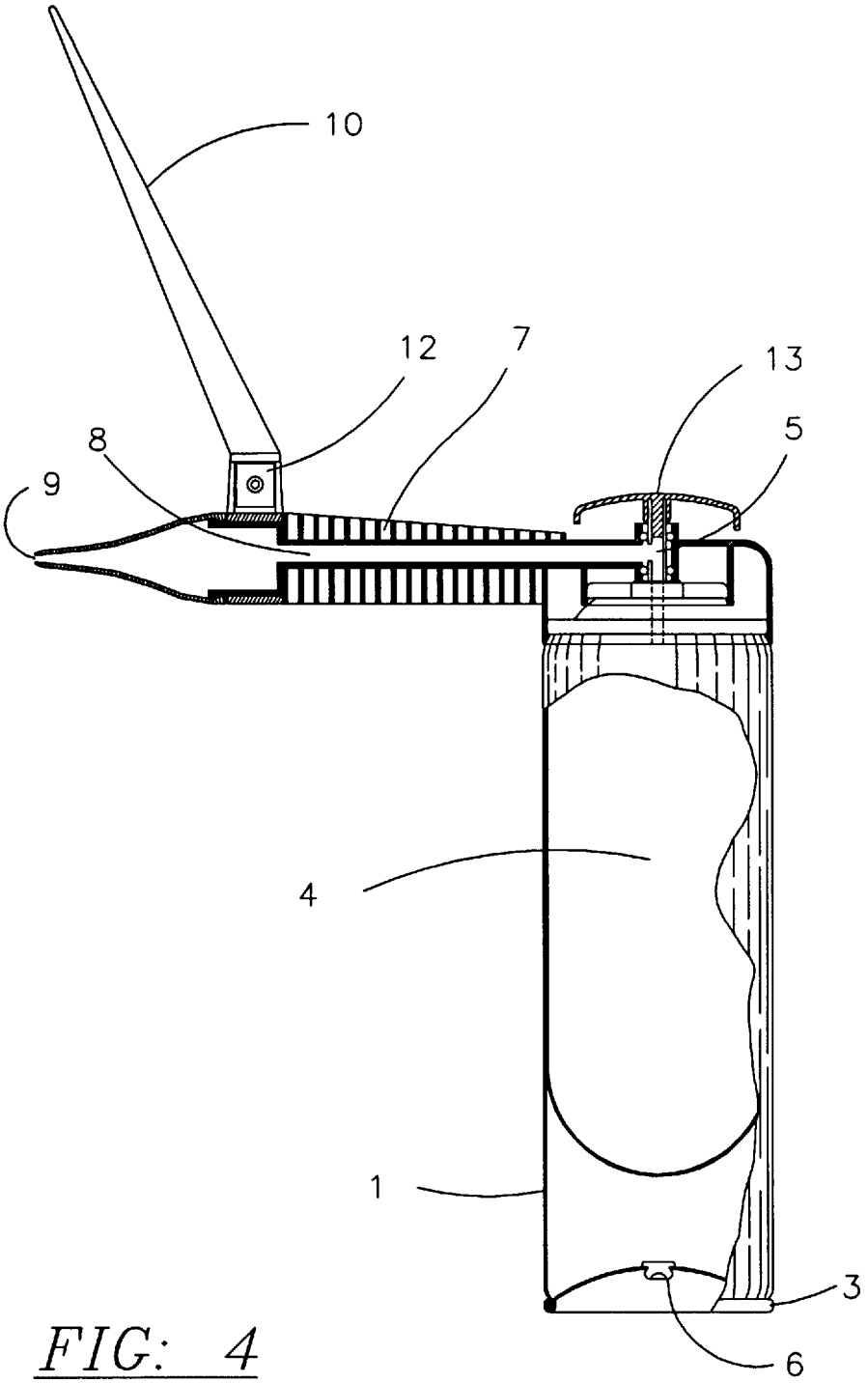
FIG. 4 is a cross-sectional view of the container showing a modified form of the container shown in FIG. 2.

In the modified versions of the invention shown in FIGS. 4–7, like numerals identify identical corresponding structural elements embodied in the container shown in FIG. 2. During the dispensing operation of the container shown in FIG. 2, the downward movement of applicator arm 7 causes it to rotate counterclockwise, as shown in FIG. 2, with respect to the axis of body element 1. In the container as shown in FIG. 4, applicator arm 7 is maintained at a fixed angle with respect to the axis of body element 1. In operation, the manual activation of push button 13, in a downward direction, activates valve 5 whereby hair treatment chemical is caused to be dispensed through channel 8 to opening 9. By this improvement, chemical is dispensed with greater precision and accuracy.

Figure 5:
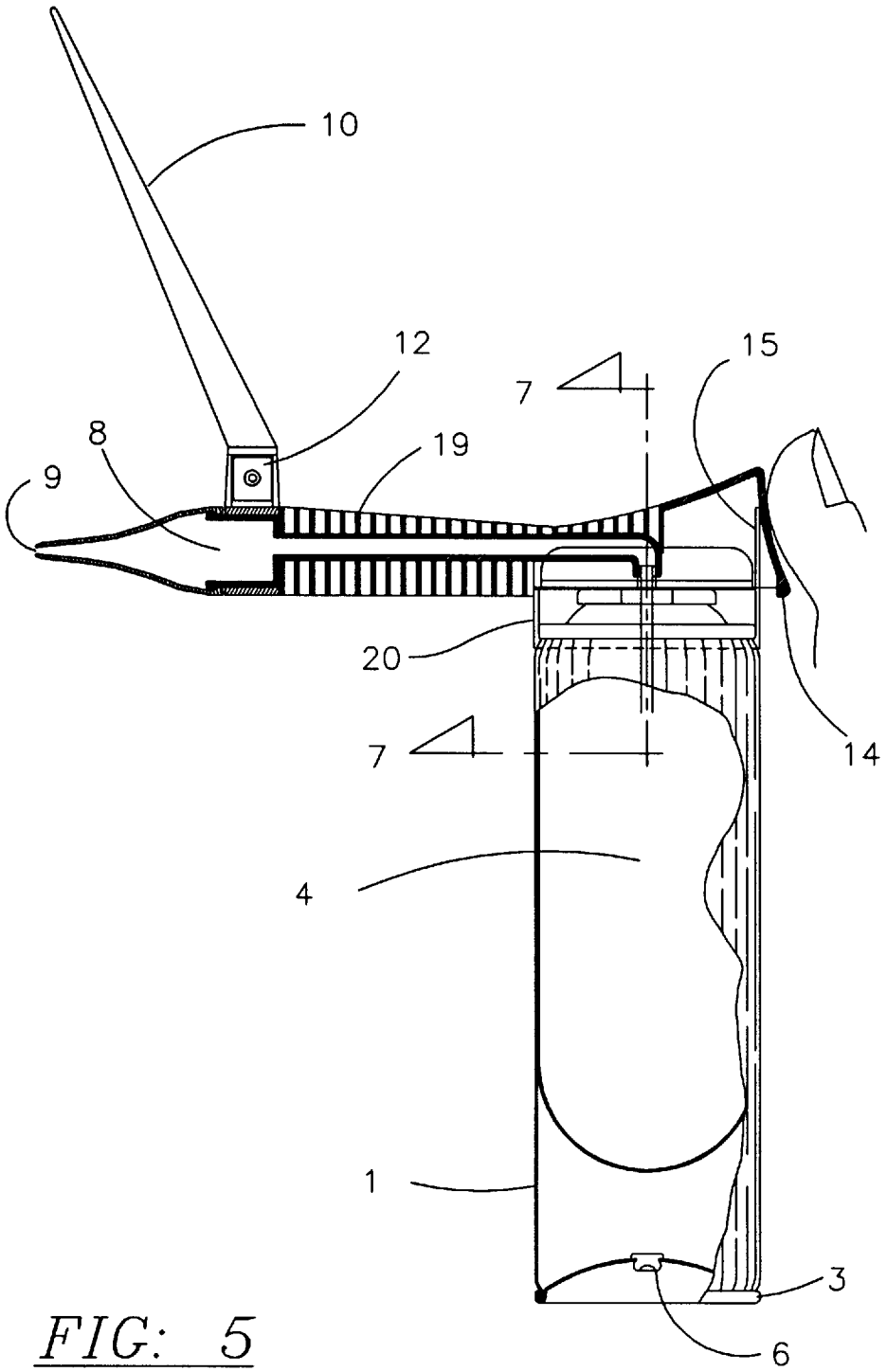
FIG. 5 is a cross-sectional view of the container showing a further modified form of the container shown in FIG. 2.
Figure 6:
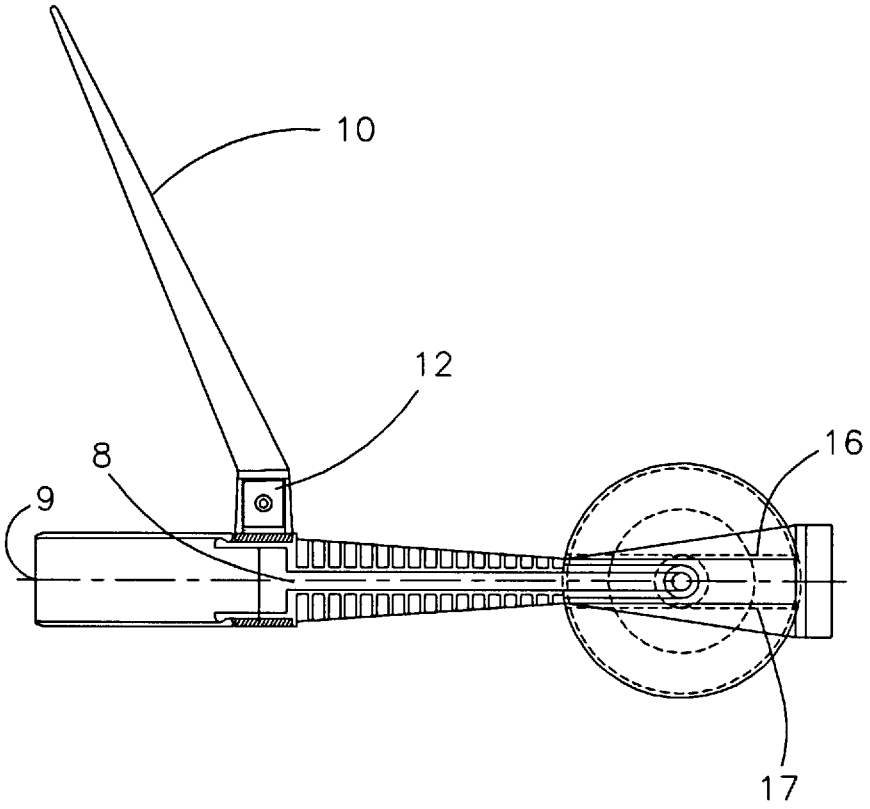
FIG. 6 is a top plan view of the container shown in FIG. 5.
Figure 7:
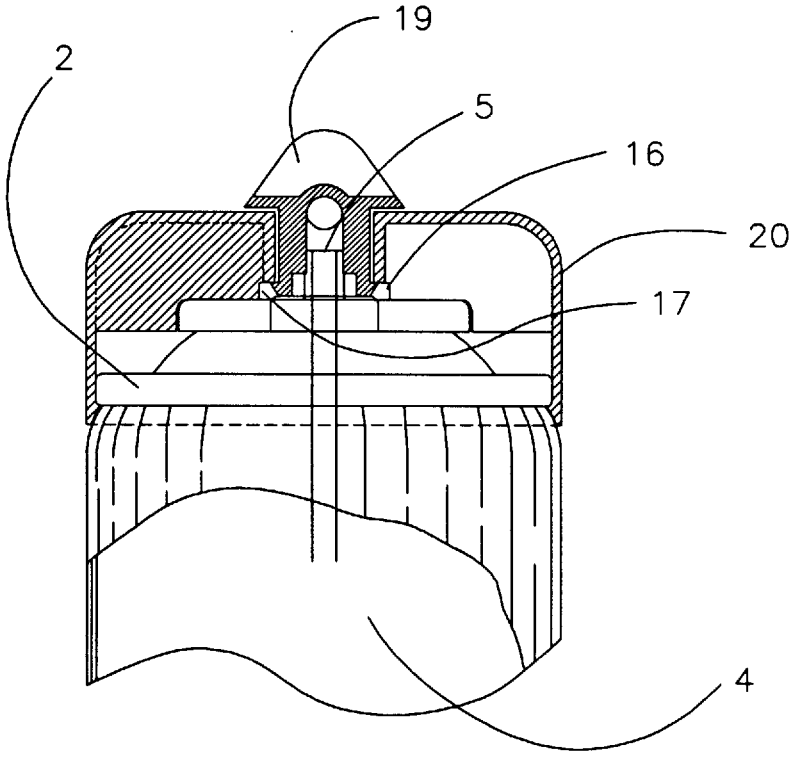
FIG. 7 is a cross-sectional view taken along the line 7—7 in FIG. 5.

In the modification of the invention shown in FIGS. 5, 6 and 7, end tab 14 is an integral part of the proximal end of applicator arm 19 and overlies resilient retention spring 15 which is an integral part of attachment cap 20 which in turn is detachably secured to container top 2. Further, applicator arm 19 is slidably disposed in grooves 16 and 17 which are molded into attachment cap 20, as best shown in FIG. 7.

In order to initiate the dispensing operation of the container shown in FIG. 5, it is simply necessary to press end tab 14 which simultaneously causes retention spring 15 to deflect to the left, as shown in FIG. 5. This causes applicator arm 19 to slide within grooves 16 and 17 to the left, as shown in FIG. 5.

By this operation, valve 5 is activated resulting in hair treatment chemical being dispensed through channel 8 of applicator arm 19 and forwardly through opening 9. Upon the release of end tab 14, retention spring 15 causes arm 19 to return to right, as viewed in FIG. 5, resulting in the closure of valve 5. By this version of the invention, a precisely controlled amount of hair treatment chemical is dispensed and chemical is supplied to the exact point of desired application.

In summary, by this invention, a dispensing container is provided for efficient and accurate application of hair straightening chemicals to a customer's hair. The undesirable over or under treatment of chemical is prevented since the chemical is applied in a controlled and precise manner directly to untreated hair without application to previously treated hair. Also, the problems inherent in the conventional dipped comb method of waste, spillage, and possible burning of a customer's skin are prevented.

We claim:

1. A hair relaxer and straightener dispensing container comprising a cylinder having a top and bottom interconnected to form an airtight container, a flexible bag disposed in said container, a valve associated with said top and operably interconnected with said flexible bag, an elongated applicator arm extending from said valve, a channel disposed within said applicator arm whereby activation of said valve causes deflation of said flexible bag through said channel, and a hair separation extension rotatably mounted on said applicator arm.

2. A container according to claim 1 wherein said hair separation extension is rotatably interconnected to said applicator arm by means of a band frictionally disposed around the periphery of said applicator arm.

3. A hair treatment dispensing container comprising a cylindrical body element having a container top and a container bottom interconnected to form an airtight container, a flexible bag disposed in said container, a valve disposed within said container top and operably interconnected with said flexible bag, an attachment cap overlying and disengageable with respect to said container top, an elongated applicator arm extending from said attachment cap, a channel disposed within said applicator arm whereby activation of said valve causes deflation of said flexible bag through said channel, said applicator arm disposed at a fixed angle with respect to the axis of said cylindrical body element throughout the dispensing operation, a hair separation extension rotatably mounted on said applicator arm, and a push button operably interconnected to said valve.

4. A hair treatment dispensing container comprising a cylindrical body element having a container top and a container bottom interconnected to form an airtight container, a flexible bag disposed in said container, a valve disposed within said container top and operably interconnected with said flexible bag, an attachment cap overlying and disengageable with respect to said container top, an elongated applicator arm extending from said attachment cap, a channel disposed within said applicator arm whereby activation of said valve causes deflation of said flexible bag through said channel, a hair separation extension rotatably mounted on said applicator arm, at least one groove formed in said attachment cap, and said applicator arm being slidably disposed in said groove.

5. A container according to claim 4 wherein said applicator arm has distal and proximal ends and wherein an end tab is secured to said applicator arm at said proximal end.

6. A container according to claim 5 wherein a retention spring is secured to said attachment cap and wherein said end tab overlies said retention spring.

* * * * *